United States Patent [19]

Pracht et al.

[11] Patent Number: 4,506,482

[45] Date of Patent: Mar. 26, 1985

[54] PREFABRICATED PANEL FOR BUILDING WALL CONSTRUCTION AND METHOD OF MAKING SAME

[76] Inventors: Hans J. Pracht, 1318 Mile Post Dr., Dunwoody, Ga. 30338; Thomas Obermeier, 1700 Forest Pkwy., Denver, Colo. 80220

[21] Appl. No.: 465,591

[22] Filed: Feb. 10, 1983

[51] Int. Cl.[3] ..... E04B 2/88

[52] U.S. Cl. ..... 52/235; 52/385; 52/403; 52/674

[58] Field of Search ..... 52/235, 385, 388, 674, 52/309.1, 309.2, 309.3, 309.4, 390, 391, 403, 402, 434, 451, 506

[56] References Cited

U.S. PATENT DOCUMENTS

| | | |
|---|---|---|
| 404,227 | 5/1889 | Sagendorph . |
| 438,327 | 10/1890 | Sagendorph . |
| 519,952 | 5/1894 | Hayes . |
| 582,368 | 5/1897 | Otterson . |
| 1,020,329 | 3/1912 | Swisher . |
| 1,408,983 | 3/1922 | Cameron . |
| 1,919,354 | 10/1932 | Anderson . |
| 1,946,690 | 2/1931 | Haines . |
| 1,965,282 | 11/1932 | Ellithorpe . |
| 2,063,115 | 3/1935 | Neergaard . |
| 2,357,560 | 8/1941 | Taforo, Jr. . |
| 2,857,754 | 1/1956 | Reinert . |
| 2,934,934 | 6/1957 | Berliner . |
| 2,960,803 | 8/1958 | Bonistall . |
| 3,185,748 | 1/1961 | MacDonald et al. . |
| 3,327,442 | 6/1964 | Hermann . |
| 3,340,660 | 11/1963 | Arcari . |
| 3,458,168 | 11/1966 | White . |
| 3,498,015 | 11/1966 | Seaburg et al. . |
| 3,533,206 | 7/1968 | Passeno, Jr. . |
| 3,676,970 | 7/1972 | Edwards . |
| 4,085,558 | 4/1978 | Albrecht . |
| 4,227,356 | 11/1980 | Stern et al. . |
| 4,238,914 | 12/1980 | Omholt ..... 52/403 |
| 4,251,970 | 2/1981 | Home . |

OTHER PUBLICATIONS

Buchtal USA–Prefabricated Wall Panels Faced with Buchtal Tile 1981, Buchtal Corporation, U.S.A.

Gail Prefabricated Brickplate Panels for Highrise Exteriors 1980, Gail International Corp.

*Primary Examiner*—J. Karl Bell

*Attorney, Agent, or Firm*—Burton, Parker & Schramm

[57] ABSTRACT

A prefabricated panel and method for making same for use in the construction of a wall structure for a building. Each panel section is comprised of a rigid support structure for attachment to the building framework. A plurality of facia sheets, such as tiles, overlie the exterior surface of the support structure and are resiliently bonded thereto with a means which provides limited relative movement between the facia sheets and the supporting structure. A means for sealing the joints between adjacent edges of facia sheets on a single panel section is provided, and once the panels are installed on a building framework, means for sealing the joints between adjacent panels is also provided in order to form a contiguous weathertight wall surface.

18 Claims, 13 Drawing Figures

PREFABRICATED PANEL FOR BUILDING WALL CONSTRUCTION AND METHOD OF MAKING SAME

FIELD OF INVENTION

This invention relates to the field of building wall construction and more particularly to construction of building walls using prefabricated panels covered with a plurality of facia sheets resiliently mounted to the panel supporting structure.

BACKGROUND OF INVENTION

A great number of modern buildings are being constructed using prefabricated panels which are individually attached to the building framework to form a wall structure. Many buildings today are constructed using prefabricated panels attached to the building structure to constitute the building's facade or skin. The materials commonly used for these panels today are: concrete, brick and tile. The brick and tile panels generally utilize a cement mortar setting bed and grout joints for bonding the brick or tile to the panel. This setting bed and related grout joint is vulnerable to cracking due to erection or wind stress and freeze thaw action. Moisture penetration as a result of this cracking can damage the panel and cause appearance problems due to efflorescence.

There has also been in use a prefabricated masonry panel in which 4"×8" ceramic tile are secured by mortar and stucco to a metal supporting frame. This is described in a publication entitled BUCHTAL PREFABRICATED TILE PANEL SYSTEM, published in 1981 by Buchtal Corporation, U.S.A. This structure has met with substantial commercial success but must be handled carefully during transport and erection to avoid deflection which will lead to cracking of the masonry structure particularly at the grout joint between the tiles. Because of the difficulties inheritant in handling this structure, to avoid deflection the size has been limited to about 150 square feet.

SUMMARY OF THE INVENTION

We have developed a facade system which is composed of panels on which tile or other facade material can be adhered to without the use of mortar and the aforementioned problems associated with the use of mortar. The facade material is adhered to the steel skin with a resilient adhesive such as a silicone adhesive allowing differential movement of the frame without damage to the facade material. The panel consists of the following components:

a. Steel studs surrounded by a steel track at the perimeter constitute a basic steel frame.

b. Metal decking is screwed or welded to the steel frame with a steel closer at the perimeter to close off the metal deck at the edges. The hats or outer portion of the steel decking may be perforated to allow the adhesive to penetrate the metal decking if a mechanical fastener in the form of an adhesive rivet and a positive contact control is desired.

c. A spacer in the form of tape is applied to the metal deck to allow the adhesive to develop dimension and to act as a cushion between the facade material and the metal decking.

d. The adhesive is applied to the steel decking and the facade material is pressed into the adhesive. The joints between the facade material are caulked and the panel is complete.

These panels are then erected and attached to the structural framework, the joints between prefabricated panels are caulked and this portion of the buidling facade is complete.

BIREF DESCRIPTION OF THE PREFERRED EMBODIMENT

Figure 1:
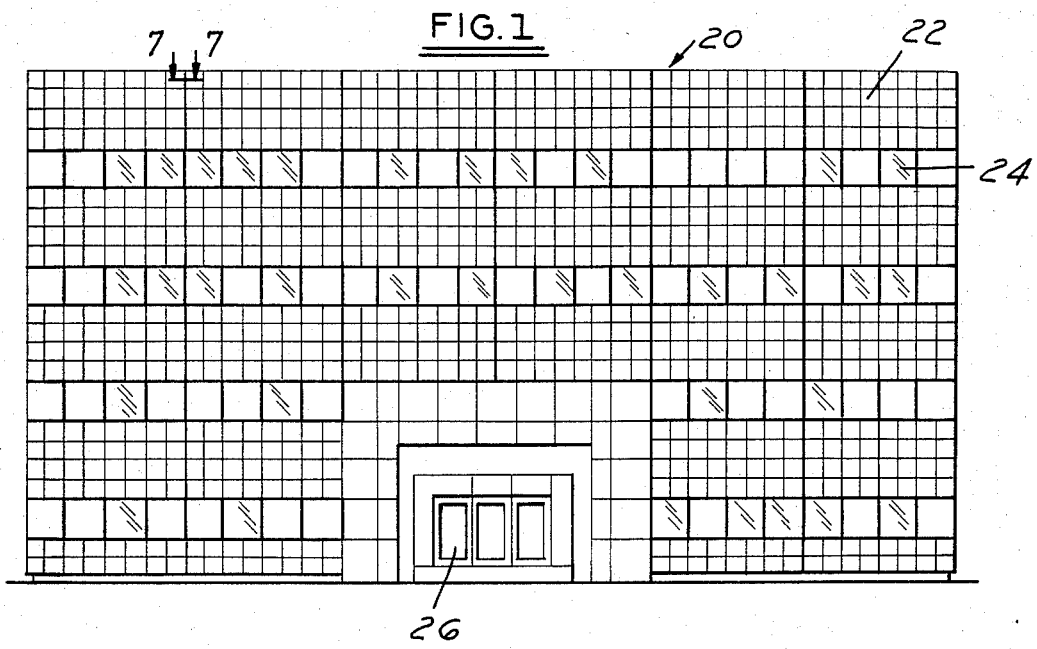
FIG. 1 is a side elevation of a building constructed using a series of prefabricated panels embodying the invention.
Figure 2:
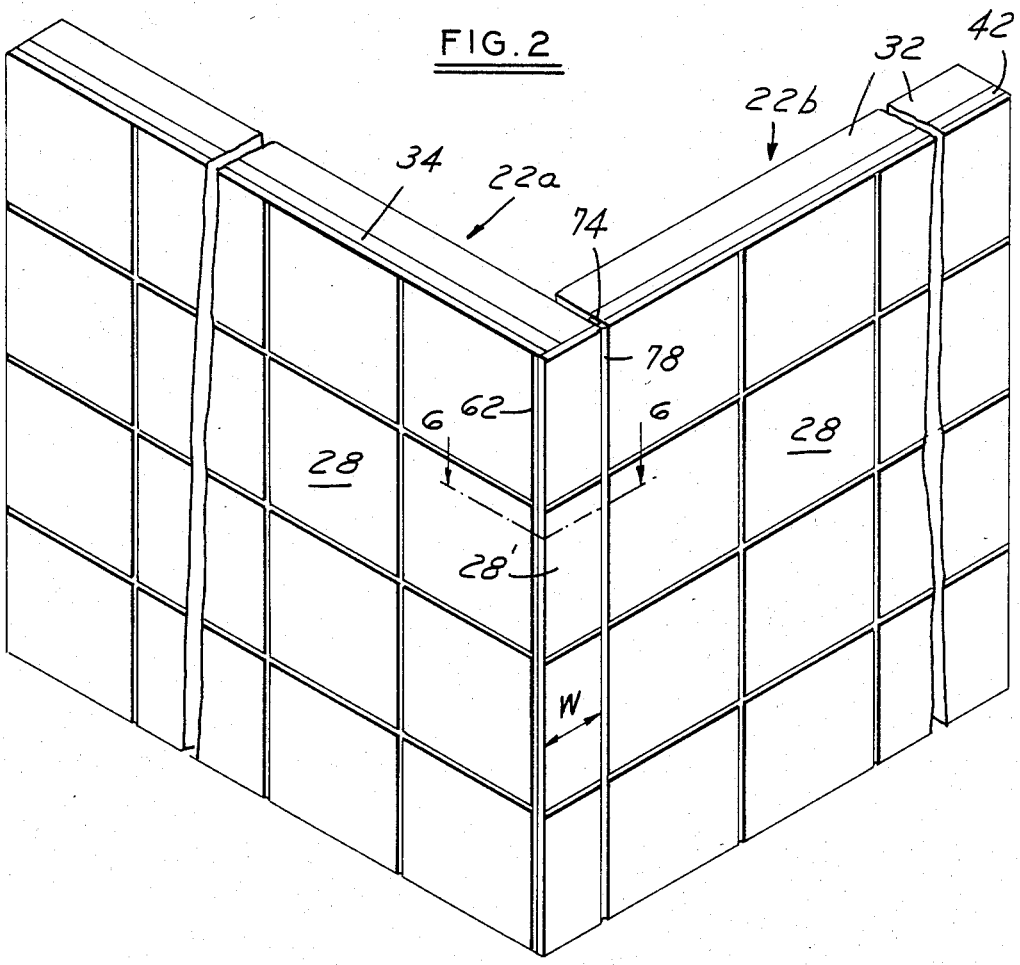
FIG. 2 is an objective view of a building corner formed by two of the prefabricated panels joined at right angles.
Figure 6:
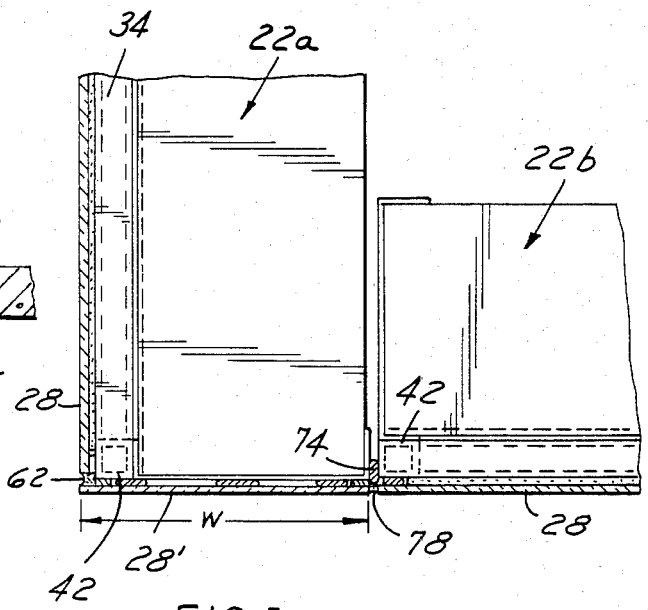
FIG. 6 is a cross-sectional end view of a corner taken along line 6—6 of FIG. 2.
Figure 5:
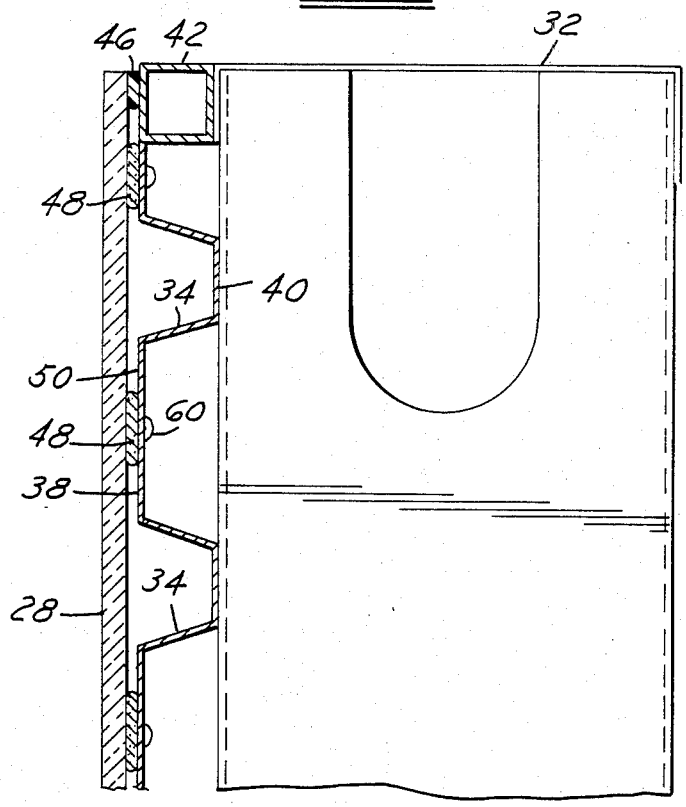
FIG. 5 is an enlarged cross-sectional view of the top of the panel shown in FIG. 4.

Referring to the drawings, FIG. 1 shows a side elevation of a building wall 20 which is formed by attachment of prefabricated architectural panels 22, window panels 24, and entrance way 26 to a building frame which is not shown. Each panel 22 has one surface covered with a series of facia sheets 28. Such sheets are formed of material such as ceramic tiles (either glazed or unglazed), stone (either natural or synthetic), glass tiles, porcelain tiles or brick. These sheets are secured in panel 22. The term "synthetic stone" is intended to include products such as stone chips in a matrix of a synthetic resin binder sold under the trademark FRITZ tile, manufactured by Fritz Chemical Company, 500 Sam Houston, Mesquite, Tex. In the ceramic or masonry materials. When a building corner is formed having architectural panels **22*a* and 22*b*, as shown in FIGS. 2 and 6, the exposed edge of the architectural panel 22*a* is covered with a series of facia sheets 28' having a width W equal to the panel's thickness. The panels 22** are all fabricated prior to the building's erection, allowing each panel to be individually raised and attached to the building framework without requiring the time and labor necessary to attach and align each of the individual facia sheets to the building surface.

FIGS. 3–8 show details as to the construction of a preferred embodiment of the panel. As can be seen in the figures, the panel's rigid support structure is comprised of a rectangular frame 30 formed of structural steel channel sections 32, for example, of a 16 or 18 gauge material, or otherwise, selected to meet the design load requirements. A metal decking 34 is then secured to the channel sections 32 of frame 30, using fasteners 36, such as screws, rivets or spot welding. The deck 34 may be formed of 22 gauge galvanized steel which may also be varied to meet the design load requirements. The deck is formed having a series of parallel ridges 38 and grooves 40 referred to in the trade as hats and valleys, respectively. Grooves 40 form a lower surface which is attached to frame 30 and ridges 38 form an upper surface for attachment of facia sheets 28. An edge bar or "deck closure" 42 which is the thickness of metal deck 34 is secured to the perimeter of frame 30 so that the ridges 38 and metal deck 34 lie along the same plane as the upper surface of edge bar 42. This combination of frame 30 which is formed of metal channel sections 32 with the attached metal deck and edge bar together comprise a rigid support structure 44 for panel assembly shown in this embodiment.

In order to secure facia sheets 28 to the panel, it is necessary to have a means for securing the facia sheets 28 to the support structure 44 to permit limited movement therebetween as the structure flexes during shipping and building assembly and subsequently due to differential thermally induced movement. The embodiment of the invention shown in FIGS. 3–8 shows a means for securing the facia sheets to the panel comprised of spacer strips 46 and an adhesive 48. Spacer strips 46 are secured to the upper surface 50 of the panel support structure 44 which is defined by the ridges 38 in the metal deck 34 and the edge bar 42. Spacer strip 46 is secured to support structure surface 50 by an adherent material 52 which preferably is an adhesive film on one face of the strip. Spacer strips 46 are laid out in a grid pattern to underly facia sheets 28. Spacer strips will be placed on edge bar 42 around the perimeter of the panel and beneath all joints 54 formed by adjacent facia sheets 28. Spacer strips 46 do not overlap one another, as they are secured to support structure surface 50, as it is necessary to have a uniform planar surface for attachment of facia sheets 28. The spacer strip may comprise a substrate 47 of vinyl foam tape of approximately $\frac{1}{8}$ inch thickness. This material is resilient and provides a cushion between facia sheets 44 and support structure surface 50. A neoprene material has also been used successfully for this substrate. The surface 56 of the substrate 47 which contacts facia sheets 28 is preferrably nonadherent and for this purpose may be coated with a nonadherent film which is referred to as a "bond breaker" surface. A spacer strip manufactured by the 3M Company and identified simply as a vinyl foam tape has been found to perform satisfactorily in the construction of the panels. Such spacer strip is made of a vinyl foam material approximately $\frac{1}{8}$ inch thick having a bond breaker coating on one side and a thin adhesive layer on the other side to adhere the tape to decking.

After installing the spacer strips 46, adhesive 48 is then placed on portions of the support structure of surface 50 which are not already occupied by spacer strip 46. Due to the viscosity characteristics and plastic nature of adhesive 48, it remains in a bead, the height of which exceeds that of the spacer strip 46. Adhesive 48 is formed of a resilient material preferrably a silicon based adhesive such as Type 795 sold by Dow Corning. The amount of adhesive 48 necessary will depend upon the type of adhesive 48, the finish of the support structure surface 50, and the expected wind load to be exerted on the building wall. When using Dow Corning 795 silicon adhesive and a typical ceramic tile facia sheet, it has been found that six square inches of adhesive contact area for each square foot of tile is sufficient to retain the tile on the support structure with a good safety margin. Adhesive manufacturer's instructions for use of the product should be carefully followed, in particular noting use within the shelf life of the adhesive and wiping clean the surfaces of the metal decking and facia sheets to be contacted by the adhesive.

Figure 3:
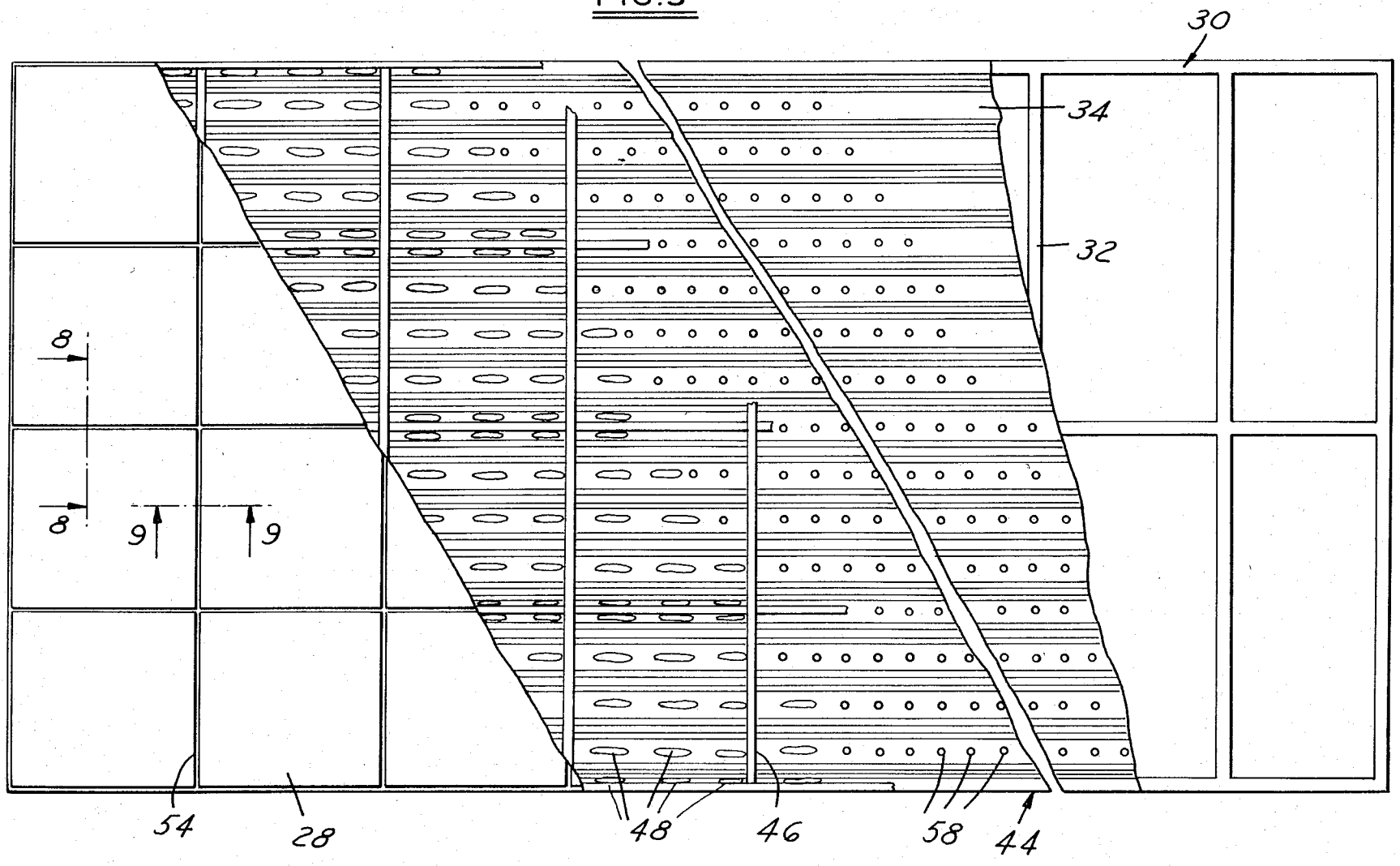
FIG. 3 is a top cut-away view of a panel.
Figure 8:
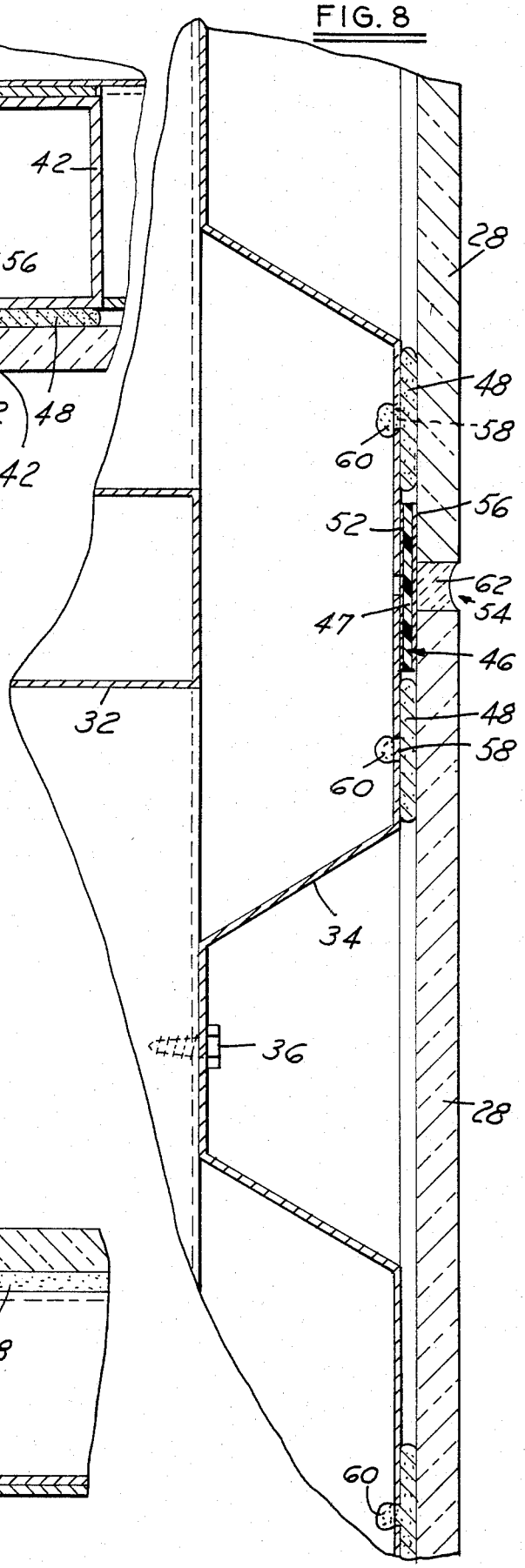
FIG. 8 is an enlarged cross-sectional view of the joint between adjacent facia sheets taken on line 8—8 of FIG. 3.

In order to provide a mechanical bonding of the adhesive 48 to the support structure surface 50, it has been found that ridges 38 in the sheet metal deck 34 may be perforated to allow the adhesive 48 to penetrate holes 58 in the ridges in the deck. Holes 58 which perforate the ridges of the deck may be arranged in a single row in the center of each ridge as shown in FIG. 3, or, alternatively, there may be several rows of perforations in each ridge as shown in FIG. 8. It is desirable, but not critical, that when spacer strip 46 is attached to the ridge of the deck, perforations are exposed on both sides of the spacer strip as shown in FIG. 3. When the facia sheets are then laid down over the adhesive, the adhesive is forced through the holes to form mushroom buttons 60 on the opposite side which, when cured, will mechanically retain the adhesive 48 to sheet metal deck 34. Such buttons are a positive indication of good contact between the adhesive and facia sheets and decking. Facia sheets 28 are installed on upper support structure surface 50 prior to curing of adhesive 48. As facia tiles 28 are installed, the adhesive deforms to the thickness of spacer strip 46 and causes some adhesive to flow through holes 58 in the sheet metal deck 34 to form button 60. After the adhesive 48 has cured, facia sheets 28 will be resiliently bonded to the supporting structure of the panel.

Figure 9:
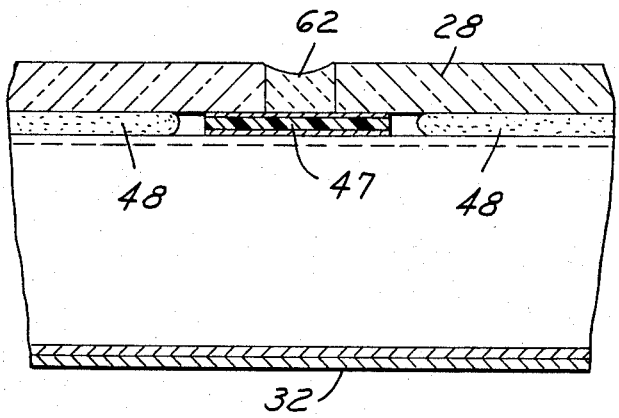
FIG. 9 is an enlarged cross-sectional view of the joint between adjacent facia sheets taken on line 9—9 in FIG. 3.

After the facia sheets 28 are installed on the support structure surface 50, the joints 54 between adjacent panels are sealed, using a caulk 62. Spacer strip 46 underlies the joints 54, cooperating with the caulk to provide a surface to support the caulk prior to hardening, as shown in FIGS. 8 and 9. Caulk 62 will preferrably not adhere to spacer strip 64. In order to provide spacer strip 46 with a surface to which caulk 62 will not adhere, a nonadherent surface 56 may be applied to spacer 46. As a result of the caulk 62 adhering only to facia sheets 28 and not spacer strip 46, the caulk joint 54 will remain weathertight despite the movement of facia sheets 28 relative to the panel support structure which is caused by deflection of the support structure during transportation, installation or as a result of thermal expansion.

Figure 4:
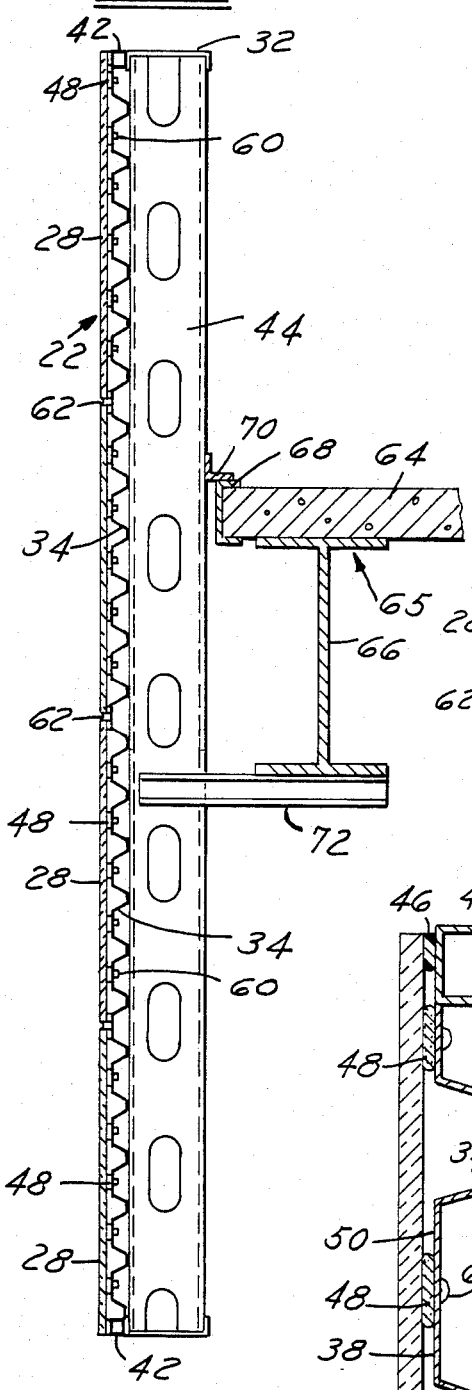
FIG. 4 is a side cross-sectional view of a panel attached to a building frame in a spandrel panel manner.

Referring to FIG. 4, a cross-section of an panel 22 is shown attached to building structural frame 65 consisting of floor 64 and horizontal beam 66. A closure channel 68 is attached to floor 64 to provide a means for attachment of the panel 22 onto the building framework. An L-bracket 70 is welded to the closure. The prefabricated panel 22 is then hoisted in place, using a crane, for example, adjusted for level and proper planar orientation and secured to the L-bracket 70, as by welding. Support 72, loosely bolted to panel 22 is rotated into contact with horizontal beam 66 and secured in place as by welding. As a final step, support 72 is welded to the panel to permanently secure the panel 22 in proper orientation. Each panel is thereby independently attached to the building framework.

Figure 7:
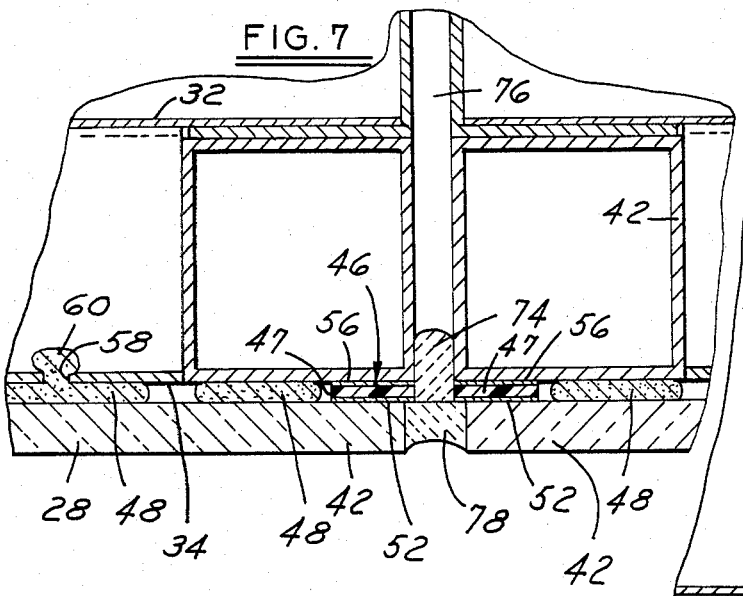
FIG. 7 is an enlarged side sectional view of the joint between adjacent panels taken along line 7—7 of FIG. 1.

With all the panels 22 installed on the building, the joints between adjacent panels are sealed to form a contiguous weathertight wall surface. The details of a preferred means for sealing the joints between adjacent panels is shown in FIG. 7. A backer rod 74, which is formed of a strip of synthetic foam material is forced into the gap 76 between adjacent panels. Backer rod 74 is initially larger than gap 76, causing it to be compressed as it is installed. Caulk 78 is then installed over backer rod 74, filling the space between facia sheets 42 located on adjacent panels 22. Backer rod 74, in addition to supplying a backing for caulk 76, acts as insulator preventing heat transfer between the inside and the outside of the building. It has been found that a round section of polyethylene foam provides a satisfactory backer rod material 74 for sealing the gaps 76 between adjacent architectural panels 22. The caulk 68 applied in the gaps between adjacent panels, as well as the caulk 62 applied in the gaps between adjacent facia sheets 28 on a single panel may be any weathertight caulking material and need not be a structural adhesive.

Figure 10:
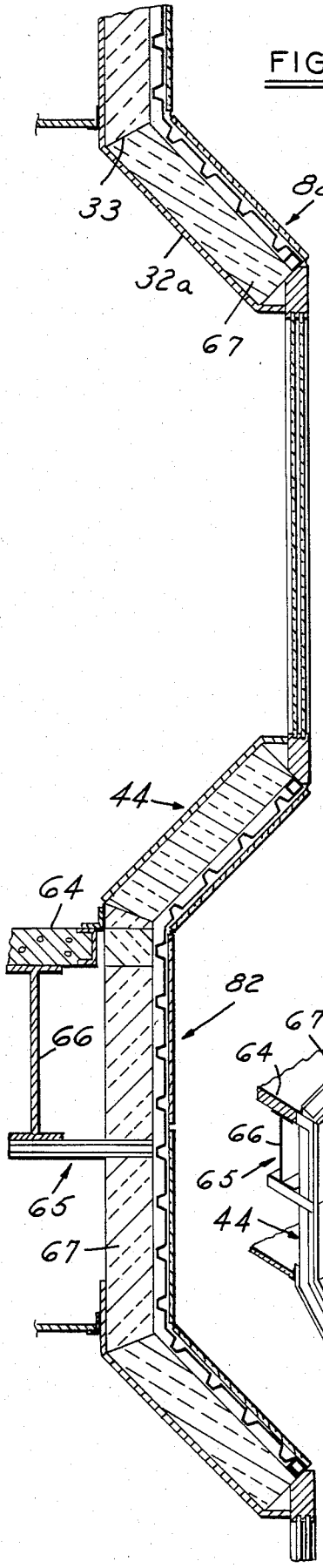
FIG. 10 is a cross-sectional side view of an alternative embodiment of the invention installed on a building framework in a spandrel panel manner showing a window extending between two panel sections.
Figure 11:
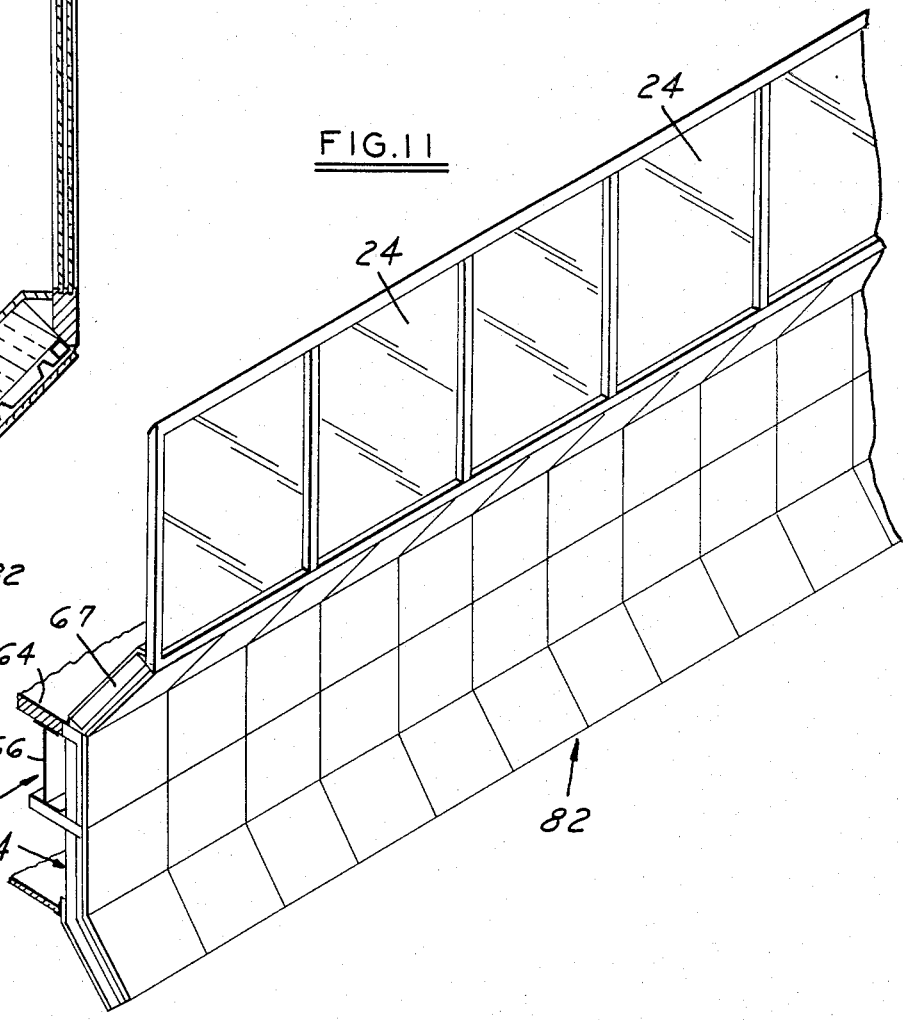
FIG. 11 is an objective view of the alternative panel configuration of FIG. 10.
Figure 12:
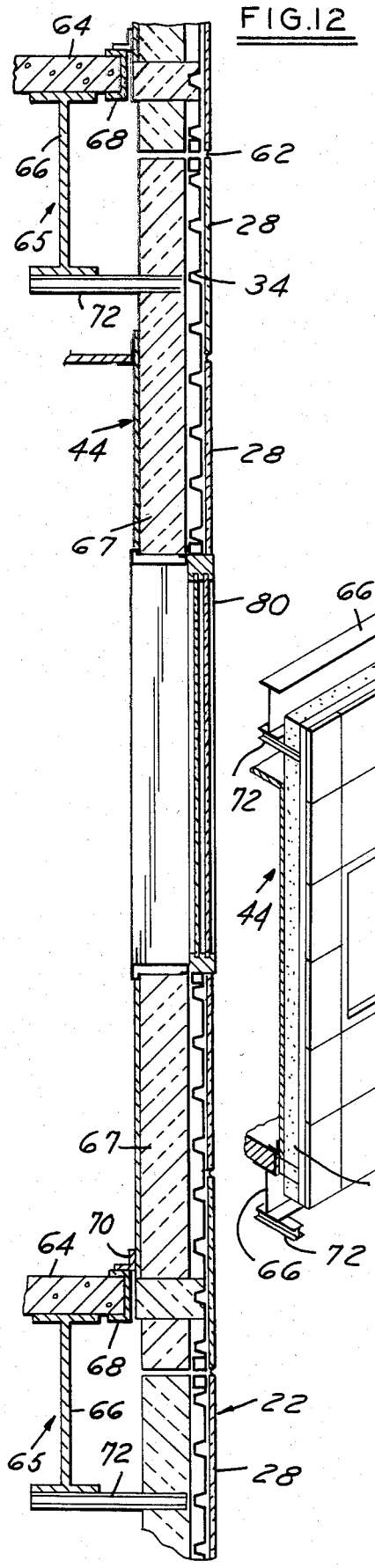
FIG. 12 is a cross-sectional side view of another alternative embodiment of the invention installed on a building framework.
Figure 13:
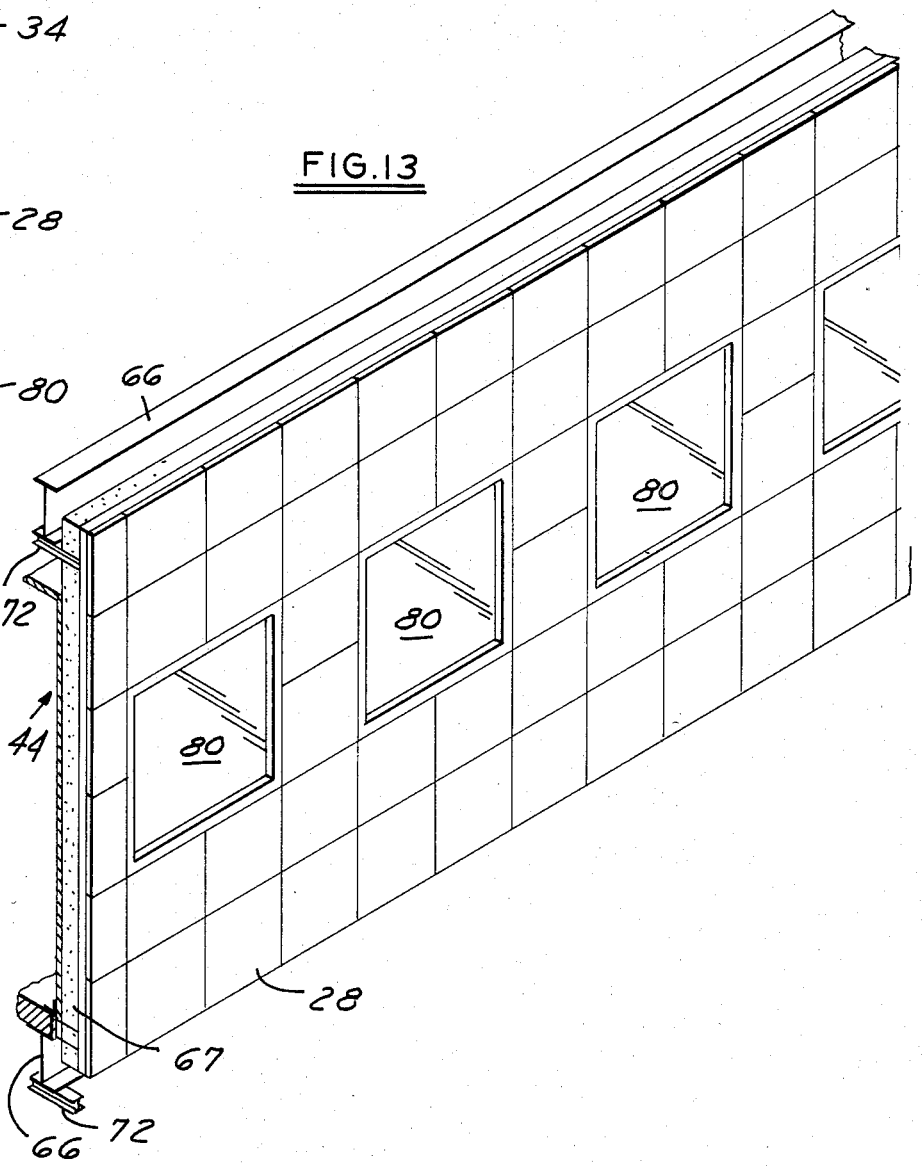
FIG. 13 is an objective view of the alternative embodiment of the invention shown in FIG. 12, showing a combination of facia sheets and windows in a single panel arrangement.

As shown in the alternative embodiments of the panel shown in FIGS. 10 and 11, this invention is not limited to panels forming a flat rectangular surface. Panels employing this invention may also incorporate window sections as shown in FIGS. 12 and 13. Panels employing this invention may cantilever off the structural frame 65 as shown in the preferred embodiment, or span between structural frames as the alternative embodiment shown in FIGS. 12 and 13. Panels may incorporate windows 80 in the body of the panel. Shaped panels 82 are also possible with this system. The steel channels 32 are cut, bent to the desired angle and welded as at 33 as shown in FIG. 10. The resulting panel gives the building facade an additional dimension and can be used to extend the floor area 64, act as a sun shading device, or as an aesthetic device.

Once the building's walls have been erected and the building is weathertight, insulation 67 may be installed in the space provided in the interior of the panel supporting structure 44 to minimize heat transfer between the interior and the exterior of the building. It is preferable that the insulation is added after the building is constructed, rather than during the formation of the individual panel units, since the insulation may become exposed to rain during transportation and construction.

We claim:

1. In a wall structure for a building having a plurality of prefabricated panel sections secured to the building framework to form a wall surface, each panel section comprising:

a rigid support structure for attachment to the building framework including a structural frame and a formed metal deck secured to the frame, said deck having alternating ridges and grooves;

a plurality of facia sheets overlying one side of said support structure, said sheets formed of material selected from the group consisting of ceramics and masonry;

means for resiliently securing the facia sheets to the support structure for permitted limited relative movement therebetween; and means for sealing the joints between adjacent edges of the facia sheets.

2. The invention of claim 1 wherein the facia sheets overlie one surface of the deck;

means between the ridges of the deck and the facia sheets for spacing the sheets from the deck; and resilient adhesive means for bonding said facia sheets to the deck.

3. The invention of claim 2 wherein the means for spacing the facia sheets from the deck comprises resilient strips secured to the deck beneath adjacent edges of facia sheets and cooperating with the means for sealing the joint.

4. The invention of claim 3 wherein said resilient spacing strip has an adherent side secured to the deck and a nonadherent side beneath said facia sheets and cooperating with the means for sealing the joints between edges of the facia sheets.

5. The invention of claim 2 wherein the resilient adhesive means for bonding comprises a silicon based structural adhesive.

6. The invention of claim 5 wherein the adhesive forms a resilient layer the thickness of the spacer.

7. The invention of claim 2 wherein the deck is perforated.

8. The invention of claim 7 wherein said adhesive penetrates the perforations in the deck to form a mechanical and adhesive bond between the deck and the facia sheets.

9. The invention of claim 1 wherein the means for securing the facia sheets to the support structure comprises:

resilient spacer means for spacing the facia sheets from and parallel to a surface of the support structure;

resilient adhesive means for bonding said facia sheets to the panel supporting structure;

said spacing and adhesive means providing a resilient attachment between the facia sheets and the panel supporting structure, allowing the panel to deflect without detachment of the facia sheets.

10. The invention of claim 9 wherein the resilient spacer means for spacing the facia sheets from the supporting structure comprises resilient strips secured to the panel supporting structure beneath adjacent marginal edges of the facia sheets and underlying and supporting the means for sealing the joint.

11. The invention of claim 10 wherein the adhesive comprises a silicon based structural bonding material forming a resilient layer the thickness of the spacer.

12. The invention of claim 11 wherein the surface of the panel support structure to which the facia sheets are attached is perforated, and said adhesive extends through the perforations forming a mechanical and adhesive bond.

13. A prefabricated panel comprising:

a rigid support structure for attachment to a building including a structural frame and a formed metal deck having alternating ridges and grooves secured to the frame;

a plurality of facia sheets overlying one side of the support structure;

means for securing said facia sheets in spaced relation to the support structure while permitting limited relative movement therebetween; and means for sealing the joints between adjacent facia sheets in the panel.

14. The invention of claim 13 wherein the facia sheets overlie one surface of the deck;

means between the ridges of the deck and the facia sheets for spacing the sheets from the deck; and resilient adhesive means for bonding said facia sheets to the deck.

15. The invention of claim 14 wherein the means for spacing the facia sheets from the deck comprises resilient strips secured to the deck beneath adjacent edges of facia sheets and cooperating with the means for sealing the joints between adjacent facia sheets.

16. The invention of claim 15 wherein:

said resilient strips have an adherent side bonded to the deck and a nonadherent side beneath said facia sheets cooperating with the means for sealing the joints between edges of adjacent facia sheets; and said resilient adhesive means is comprised of a silicon based structural adhesive forming a layer substantially the thickness of the spacing strip.

17. The invention of claim 16 wherein the deck is perforated and the structural adhesive extends through the perforations forming both a mechanical and adhesive bond.

18. A building wall panel comprising:

a frame;

a formed metal deck with alternating ridges and grooves, having an upper surface and a lower surface defined by said grooves which is secured to the frame;

a network of spacer strips arranged on the deck and having a nonadherent upper surface and a lower surface bonded to the upper surface of the deck;

a silicon-based adhesive on the upper surface of the deck;

a plurality of facia sheets on the network of spacer strips contacting the adhesive to bond the facia sheets to the deck, the edge of each facia sheet overlying a spacer strip, the edges of adjacent facia sheets separated by a gap and overlying a common spacer strip;

a caulk in the gaps between the adjacent facia sheets providing a weathertight seal therebetween, said caulk contacting the nonadherent surface of the spacer strip.

* * * * *